US005322583A

United States Patent [19]

Wharton

[11] Patent Number: 5,322,583

[45] Date of Patent: Jun. 21, 1994

[54] METHOD OF HEAT EMBOSSING MATERIALS SUBJECT TO ADHESION

[76] Inventor: Elliott Wharton, P.O. Box 338, Damascus, Ohio 44619

[21] Appl. No.: 5,440

[22] Filed: Jan. 19, 1993

[51] Int. Cl.[5] ..... B32B 31/20

[52] U.S. Cl. ..... 156/209; 156/219; 156/289; 156/308.2; 156/323

[58] Field of Search ..... 156/209, 219, 221, 247, 156/289, 323, 308.2, 308.4, 309.6; 428/88, 170, 171, 187; 264/293

[56] References Cited

U.S. PATENT DOCUMENTS 3,599,563 8/1971 Schwartz .
3,703,424 11/1972 Charnock et al. ..... 428/88
4,047,996 9/1977 Kanzelberger .
4,092,198 5/1978 Scher et al. .
4,092,199 5/1978 Ungar et al. ..... 156/219
4,683,018 7/1987 Sutcliffe et al. ..... 156/196

*Primary Examiner*—Michael W. Ball
*Assistant Examiner*—Richard Crispino
*Attorney, Agent, or Firm*—Harpman & Harpman

[57] ABSTRACT

A method is disclosed for heat embossing synthetic woven materials that exhibit adhesion properties when subject to heated dies to impart desired lettering or designs into the surface of the material. The method uses an isolation film to diminish excessive heat transfer resulting in excess adhesion to the die.

2 Claims, 1 Drawing Sheet

METHOD OF HEAT EMBOSSING MATERIALS SUBJECT TO ADHESION

BACKGROUND OF THE INVENTION

1. Technical Field

This invention relates to the field of marking and embossing materials by subjecting them to a heated die that pre-heats and melts a selected surface portion of the material, imparting a desired lettering or design permanently within.

2. Description of Prior Art

Prior art techniques for marking materials subject to high adhesion properties when heated is to hot stamp a foil of colored material to the top surface of the material, examples of related prior art stamping techniques are evident in U.S. Pat. Nos. 3,599,563, 4,047,996 and 4,092,198.

In U.S. Pat. No. 3,599,563 a method for marking materials can be seen in which a groove is formed in the direction of the material elongation. Applying a colored material within the grooves so that the colored material adheres to the sides of the grooves preventing elongation and breaking of the coloring material upon elongation of the material.

In U.S. Pat. No. 4,047,996 a method to imprint plastic plates is disclosed wherein hot stamping a plastic laminate to achieve a high color contrast of the desired design to the background material uses a pressure sensitive adhesive that is stamped, then adhesively applied to the surface material.

Pat. No. 4,092,198 is drawn towards a process for high pressure decorative laminate having registration colors. A sculptured pressing plate die impacts a multiple construction in which a coded print sheet is laminated to a core support sheet with an overlay sheet and a release sheet.

SUMMARY OF THE INVENTION

A method of heat embossing materials by use of a heat resistant distortable intermediate material between the heat embossing die and the target material that is subject to high adhesion properties when melted during the embossing process.

DESCRIPTION OF THE PREFERRED EMBODIMENT

Figure 1:
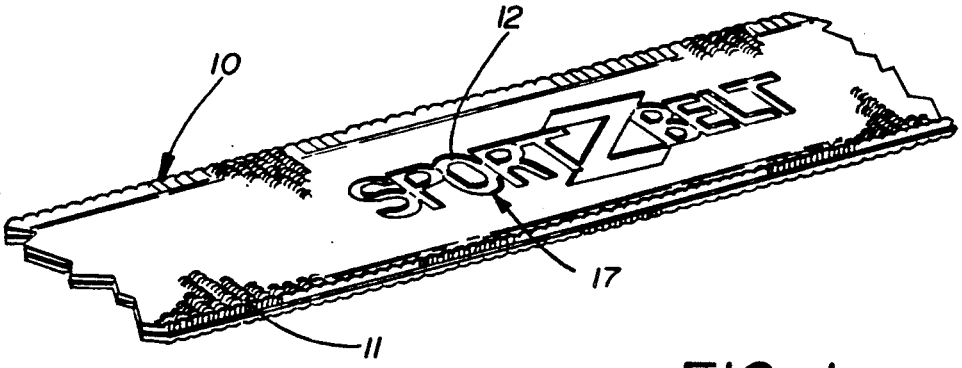
FIG. 1 is a perspective view of a portion of a nylon belt embossed with a desired design.

Referring to FIG. 1 of the drawings, there is shown a portion of a plastic synthetic resin (nylon) article 10 which is comprised of a woven synthetic resin yarn that defines a pattern textured surface 11. Indecia is embossed by heat within the surface 11 defining a recessed contoured flattened grooves 12.

Figure 2:
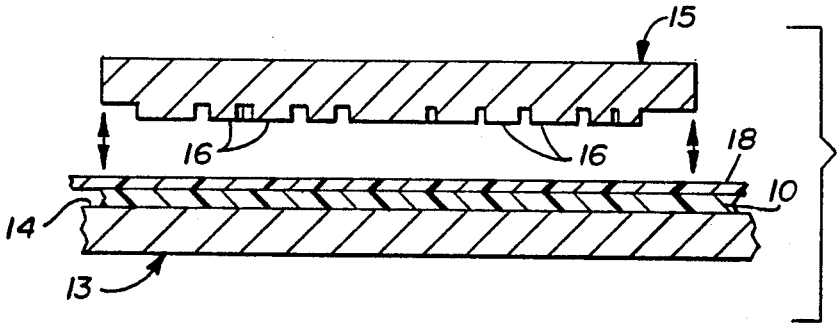
FIG. 2 is a cross-sectional view of an embossing die nylon work piece prior to embossing.

Referring now to FIG. 2 of the drawings, an article support base 13 can be seen having a generally flat upper surface 14 to receive and support the article 10 during the heat embossing process. A die 15 is positioned in spaced vertical alignment relative said support base 10. The die 15 is characterized by a plurality of contoured protrusions 16 that are configured in a desired design 17 that is the subject of the embossing process.

Figure 3:
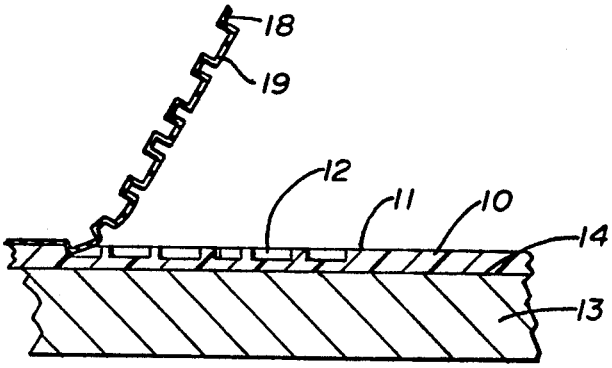
FIG. 3 is a cross-sectional view of the work piece after embossing.

Referring now to FIGS. 2 and 3 of the drawings, a technique for carrying out the embossing method of the invention is shown wherein the woven synthetic material based article 10 is positioned on the flat upper surface 14 of the support base 13. An isolation film 18 referred to under the brand name as Garlock® teflon sheet is positioned over the textured surface 11 of the synthetic resin material article 10 as best seen in FIG. 2 of the drawings.

The isolation film 18 has a specific inherent specification determined under ASTM test method that provides for its unusual and unexpected end result when used in the method described herein that is the subject of the invention.

The physical properties of the isolation film 18 as tested under the specific ASTM methods are noted as follows:

| PHYSICAL PROPERTIES | ASTM TEST METHOD | TEST RESULTS |
|---|---|---|
| Specific Gravity | D-1457-56-T | 2.10–2.20 |
| Hardness (Shore D-76° F.) | | 52–56 |
| Ultimate Tensile Strength, psi | D-1457-56T | 3000 min. |
| Ultimate Elongation, % | D-2457-56T | 200 min. |
| Dielectric Strength, | D149a | |
| v per mil 1/16" | | |
| In Oil | | 500 min. |
| Dielectric Constant | D150-54T | |
| At 60 cps | | 2,1 |
| At $10^6$ cps | | 2,1 |
| Dissipation Factor | D150-54T | |
| At 60 cps | | 0.0003 |
| At $10^6$ cps | | 0.0003 |
| Volume Resistivity, ohm-cm | D257-57T | $10^{17}$ |
| | Temperature 450° F. Max. | |

In operation, the die 15 is heated by any one of a variety of conventional ways (that are well known and understood by those skilled in the art), to a pre-determined temperature indicative of the synthetic resin articles 10 melting temperature dependent on die contact time and imparted linear force against the synthetic resin article 10.

The die 15 is advanced vertically for engagement with the synthetic resin article 10 as indicated by directional arrows in FIG. 2 of the drawings. As the die 15 advances, it first engages the isolation film 18 as it embosses the textured surface 11 of the synthetic resin article 10 deforming said isolation film 18 in the selected surface areas 19 embossing by liquification of a portion of the surface 11. The isolation film 18 defines a protective membrane between the synthetic resin article 10 and the heated contoured portion 16 of the die 15, due to the physical characteristics of the isolation film 18 prevents the impacted surface areas 19 (now temporarily liquified) from adhering to the die protrusions 16 of the die 15 as it is retracted from the synthetic resin article 10 as seen in FIG. 3 of the drawings. The isolation film 18 has taken on the impression of the flattened grooves 12 at 19 of the design used as an example in the illustration of the preferred embodiment.

The synthetic resin article 10 now embossed with the desired design 17 is shown in its finished form in FIG. 1 of the drawings. By use of the method of the invention a deep sharp edge design 17 can be successfully and repeatably embossed in targeted articles characterized of synthetic woven resin configuration illustrated that heretofore provided difficult to heat emboss with acceptable repeatable results.

Having thus illustrated and described my new method of the invention, it will be apparent to those skilled in the art that various changes and modifications may be made therein without departing from the spirit of the invention, therefore I claim:

1. A method of heat embossing articles made of woven synthetic resin materials that define a patterned textured surface comprising;

(A) assembling a multiple layer arrangement in vertical ascending order of (1) a base support means (2) a woven synthetic resin textured surface article (3) an isolation film having heat dispersion and deformation properties, said film is from a group of synthetic materials having the physical properties defined under ASTM test method standards as

| PHYSICAL PROPERTIES | ASTM TEST METHOD | TEST RESULTS |
|---|---|---|
| Specific Gravity | D-1457-56-T | 2.10–2.20 |
| Hardness (Shore D-76° F.) | | 52–56 |
| Ultimate Tensile Strength, psi | D-1457-56T | 3000 min. |
| Ultimate Elongation, % | D-2457-56T | 200 min. |
| Dielectric Strength. | D149a | |
| v per mil 1/18" | | |
| In Oil | | 500 min. |

-continued

| PHYSICAL PROPERTIES | ASTM TEST METHOD | TEST RESULTS |
|---|---|---|
| Dielectric Constant | D150-54T | |
| At 60 cps | | 2,1 |
| At $10^6$ cps | | 2,1 |
| Dissipation Factor | D150-54T | |
| At 60 cps | | 0.0003 |
| At $10^6$ cps | | 0.0003 |
| Volume Resistivity, ohm-cm | D257-57T | $10^{17}$ |
| | Temperature 450° F. Max. | |

(4) a sculptured die having a plurality of contoured protrusions on its lowermost surface (B) applying to the synthetic resin article sufficient heat and pressure to emboss by partial liquification of selected areas of said woven synthetic resin article by (1) heating said die to a predetermined temperature for melting said woven synthetic resin surface (2) advancing said die into engagement with said isolation film and said woven synthetic resin article thereunder (3) deforming by heat and pressure a portion of the isolating film in contact with selected areas of said die (4) effecting a liquification of the die impinged areas of said woven synthetic resin article (5) imprinting the contoured protrusions of said heated die to an upper surface of said synthetic resin article.

2. The method according to claim 1 wherein said base supporting means comprises an elongated support base having a flat upper surface.

* * * * *